US008387276B2

(12) United States Patent
Polegato Moretti

(10) Patent No.: US 8,387,276 B2
(45) Date of Patent: Mar. 5, 2013

(54) SHOE WITH COMBINED DEVICE FOR VAPOR PERMEATION AND FORCED AIR CIRCULATION

(75) Inventor: Mario Polegato Moretti, Crocetta del Montello (IT)

(73) Assignee: GEOX S.p.A., Montebelluna (IT)

( * ) Notice: Subject to any disclaimer, the term of this patent is extended or adjusted under 35 U.S.C. 154(b) by 456 days.

(21) Appl. No.: 12/596,030

(22) PCT Filed: Apr. 4, 2008

(86) PCT No.: PCT/EP2008/054119

§ 371 (c)(1),
(2), (4) Date: Oct. 15, 2009

(87) PCT Pub. No.: WO2008/125524

PCT Pub. Date: Oct. 23, 2008

(65) Prior Publication Data

US 2010/0132228 A1 Jun. 3, 2010

(30) Foreign Application Priority Data

Apr. 17, 2007 (IT) ..... PD2007A0141

(51) Int. Cl.
*A43B 7/06* (2006.01)

(52) U.S. Cl. ..... 36/3 B

(58) Field of Classification Search ..... 36/3 B, 36/3 R, 3 A, 29

See application file for complete search history.

(56) References Cited

U.S. PATENT DOCUMENTS

| | | | | |
|---|---|---|---|---|
| 3,716,930 | A * | 2/1973 | Brahm | 36/3 B |
| 4,860,463 | A * | 8/1989 | Pin | 36/3 B |
| 5,138,775 | A * | 8/1992 | Chu | 36/3 B |
| 5,992,052 | A * | 11/1999 | Moretti | 36/3 B |
| 5,996,250 | A * | 12/1999 | Reed et al. | 36/3 R |
| 2004/0211085 | A1 * | 10/2004 | Passke et al. | 36/3 B |
| 2005/0138838 | A1 | 6/2005 | Lin et al. | |
| 2006/0272179 | A1 | 12/2006 | Passke et al. | |
| 2007/0180731 | A1 | 8/2007 | Polegato Moretti | |
| 2008/0229623 | A1 * | 9/2008 | Ferretti | 36/3 B |

FOREIGN PATENT DOCUMENTS

| | | |
|---|---|---|
| EP | 1 127 505 | 8/2001 |
| WO | 2005 011417 | 2/2005 |

OTHER PUBLICATIONS

U.S. Appl. No. 13/141,530, filed Jun. 22, 2011, Polegato Moretti.

* cited by examiner

*Primary Examiner* — Ted Kavanaugh
(74) *Attorney, Agent, or Firm* — Oblon, Spivak, McClelland, Maier & Neustadt, L.L.P.

(57) ABSTRACT

A shoe with a combined device for vapor permeation and forced air circulation including an assembly insole which is vapor-permeable or includes through holes, an upper which is fixed to the edges of the insole, a sole arranged below the insole and the edges of the upper, and at least one cavity, which is sealed from the rest provided inside the sole, the cavity having an upper wall which faces the vapor-permeable or perforated assembly insole and including a membrane which is waterproof and permeable to water vapor, the cavity having inlet and outlet ducts for changing the air contained therein.

14 Claims, 2 Drawing Sheets

SHOE WITH COMBINED DEVICE FOR VAPOR PERMEATION AND FORCED AIR CIRCULATION

TECHNICAL FIELD

The present invention relates to a shoe with a combined device for vapor permeation and forced air circulation.

BACKGROUND ART

Shoes are known which have perforated soles which allow vapor permeation due to the presence of membranes which are waterproof and permeable to water vapor and are arranged so as to cover the perforations and are sealed to the sole so as to prevent water from entering the shoe through the perforations.

Shoes are also known which have soles which expel the humid air contained in the shoe by means of forced suctions produced by means of pumps actuated within the sole by way of the movement of the foot (compression and decompression).

One of these shoes is disclosed for example in patent EP 1127505.

Shoes provided with pumping devices, however, suffer the severe drawback of having a mechanical actuation and therefore of not working when no walking occurs.

Moreover, they force the inflow of external air due to the depression or suction that the pumping devices, when actuated, produce inside the shoe, a situation which should be avoided in winter or in cases of high humidity in the environment.

The inflow of cold or very humid air is certainly not healthy for the feet.

Moreover, it should be noted that this exchange of air is quite often rendered useless due to the layers of polymeric material which are arranged below the sole of the foot to create sealed pads capable of performing the pump effect, like known pumps for inflating PVC beach mattresses.

These non-vapor permeable layers create condensation and prevent the insole in contact with the foot from drying despite air recirculation.

This problem can be observed for example in patent application US2006/0143943.

DISCLOSURE OF THE INVENTION

The aim of the present invention is to provide a shoe which solves the drawbacks noted above and in particular in which the action of transfer of the water vapor generated by sweating from the inside of the shoe to the outside is increased.

Within this aim, a primary object of the invention is to provide a shoe which also allows to change the air inside the shoe.

Another object is to devise a shoe which can be provided without difficulty by means of usual production methods.

Still another object is to provide a shoe for which the production cost is not increased significantly.

This aim and these and other objects, which will become better apparent hereinafter, are achieved by a shoe composed of an assembly insole which is vapor-permeable or provided with through holes, an upper which is fixed to the edges of the insole, and a sole below the insole and the edges of the upper, said shoe being characterized in that it comprises at least one cavity which is sealed from the rest provided inside the sole, said at least one cavity having an upper wall which faces said vapor-permeable or perforated assembly insole and is constituted by a membrane which is waterproof and permeable to water vapor, said at least one cavity further having inlet and outlet ducts for changing the air contained therein.

BRIEF DESCRIPTION OF THE DRAWINGS

Further characteristics and advantages of the invention will become better apparent from the description of some preferred but not exclusive embodiments thereof, illustrated by way of non-limiting example in the accompanying drawings, wherein.

It is noted that anything found to be already known during the patenting process is understood not to be claimed and to be the subject of a disclaimer.

WAYS OF CARRYING OUT THE INVENTION

Figure 1:
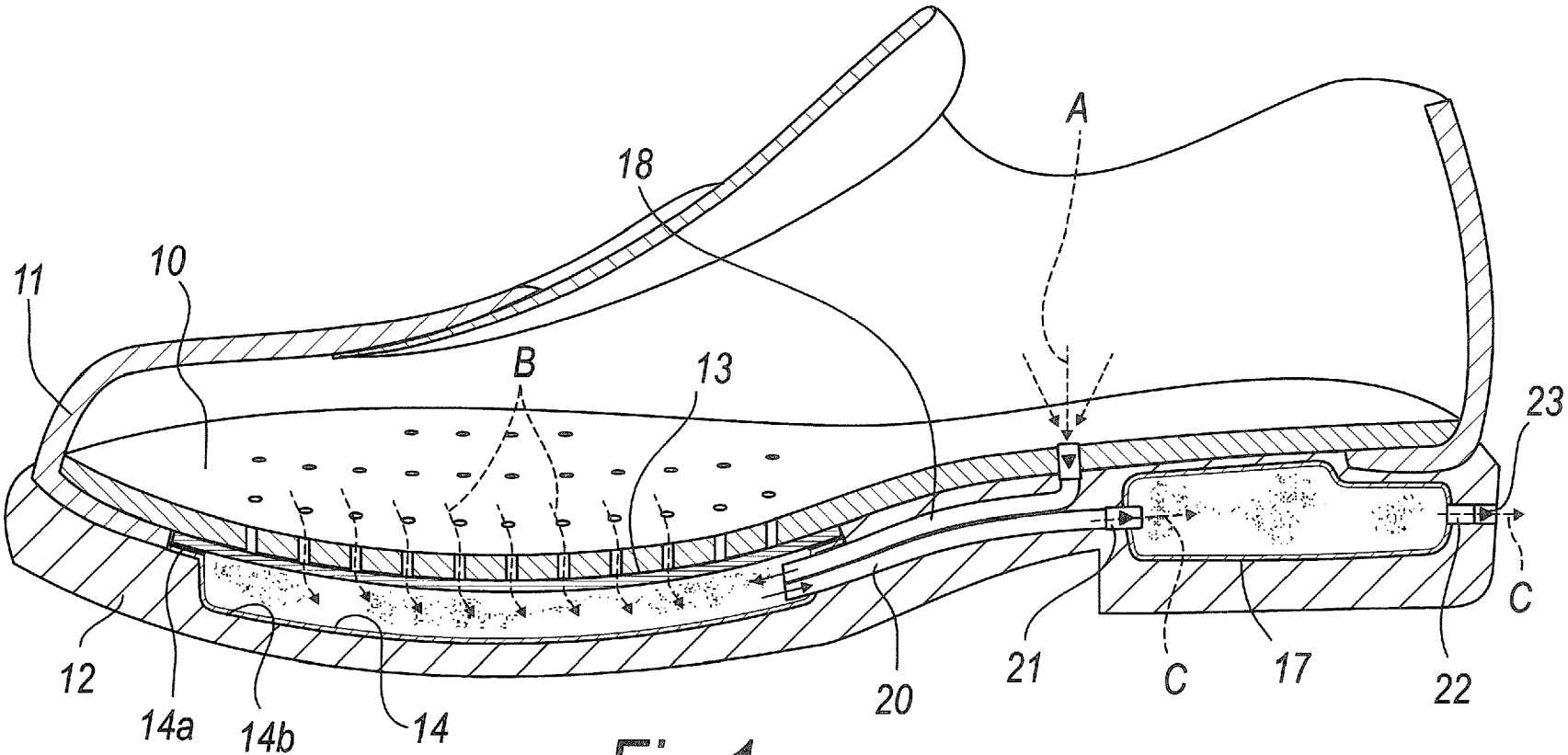
FIG. 1 is a schematic longitudinal sectional view of a first embodiment of the shoe according to the invention.
Figure 2:
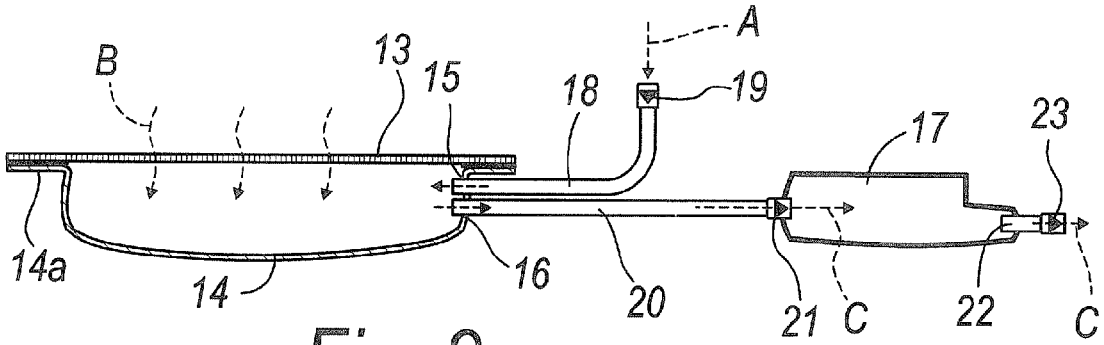
FIG. 2 is a diagram of the pumping device included in the shoe of FIG. 1.

With reference to FIGS. 1 and 2, in a first embodiment a shoe is composed, as usual, of an assembly insole 10, an upper 11, the lower edges whereof are folded around the insole 10 and are fixed thereto, and a sole 12, which is fixed (for example injection-molded or glued) below the insole 10 and the folded edges of the upper 11.

According to the invention, below the assembly insole 10, which is made of vapor-permeable and/or perforated material, in the forefoot region there is a waterproof and vapor-permeable membrane 13, made of polymeric material, such as for example polyurethane, expanded polytetrafluoroethylene or polyester, in contact with the insole 10 (or applied thereto by gluing in spots or perimetrically or in any case so as to allow the passage of water vapor from the insole through the membrane 13).

The membrane 13 must conveniently be permeable to water vapor but waterproof, of the dense type (i.e., with a non-porous layer) or of the microporous type (with a porosity which allows to create a compression chamber).

Below the membrane 13, in the sole, a first cavity 14 is provided which is sealed in an upward region with the edges 14*a* to the membrane 13 and can be pre-molded and inserted in a corresponding hollow 14*b* in the sole 12 or formed within the sole 12, if the thicknesses or the molding methods of the sole 12 allow this.

It is optionally possible to insert in the first cavity 14 material which increases the humidity absorption capacity of the membrane 13 (hydrophilic material) and consequent vapor permeation (for example, hydrophilic felt, materials with silicon, open-cell foams, et cetera).

The membrane 13, therefore, is designed to seal the underlying first cavity 14 in order to ensure pumping of the air, as will become better apparent hereinafter, and can be supported or protected by suitable layers of other materials.

The first cavity 14 has two openings, of which a first one 15 is adapted to allow the inflow of the air into the first cavity 14 and the second one 16 is adapted to allow the outflow of the air toward the outside.

A second sealed cavity 17 is formed in the heel of the sole 12.

A first duct 18 connects the first opening 15 of the first cavity 14 to the inside of the shoe, preferably in the rear portion, and has, at the end which lies opposite the opening 15, a one-way valve 19 which is adapted to allow flow from the inside of the shoe to the first cavity 14.

A second duct 20 connects the second opening 16 of the first cavity 14 to the second cavity 17 and has a second one-way valve 21, which is adapted to allow flow from the first cavity 14 to the second cavity 17.

The second cavity 17 is connected to the outside of the shoe by way of a duct 22 with a one-way valve 23, which is adapted to allow only outward expulsion.

The air from the inside of the shoe, due to the movements of the foot and of the compressions and extensions, is forcedly aspirated (arrow A) by the first cavity 14 below the insole not only during compression thereof but also during heel pressing, because the second cavity 17 is designed to enhance the depression or suction by using the compression of the heel as well.

Air suction occurs, as mentioned and shown in FIG. 1, from the inside of the shoe in the insole, but it can also occur by drawing air from outside.

The seal of the membrane 13 with the first cavity 14 arranged below the insole is important and can be achieved by direct molding or gluing or other suitable means.

If the membrane 13 is protected by layers which prevent sealing (for example, protective felts), such layers must be made suitable for sealing at least perimetrically, so as to ensure tightness between the membrane and the compression chamber.

For this purpose, for example, the protective layer can be removed perimetrically or can be reduced in thickness or be pre-impregnated with liquid adhesives or polymers.

The membrane 13 constitutes a wall of the first cavity 14 which is permeable to water vapor, which thus can enter (arrows B) the cavity regardless of the walking motion of the foot, the vapor being thus removed from the foot to be then expelled outside together with the air (arrows C) with the first movement that is performed.

In this manner, it is possible to keep dry the insole in direct contact with the foot.

Figure 3:
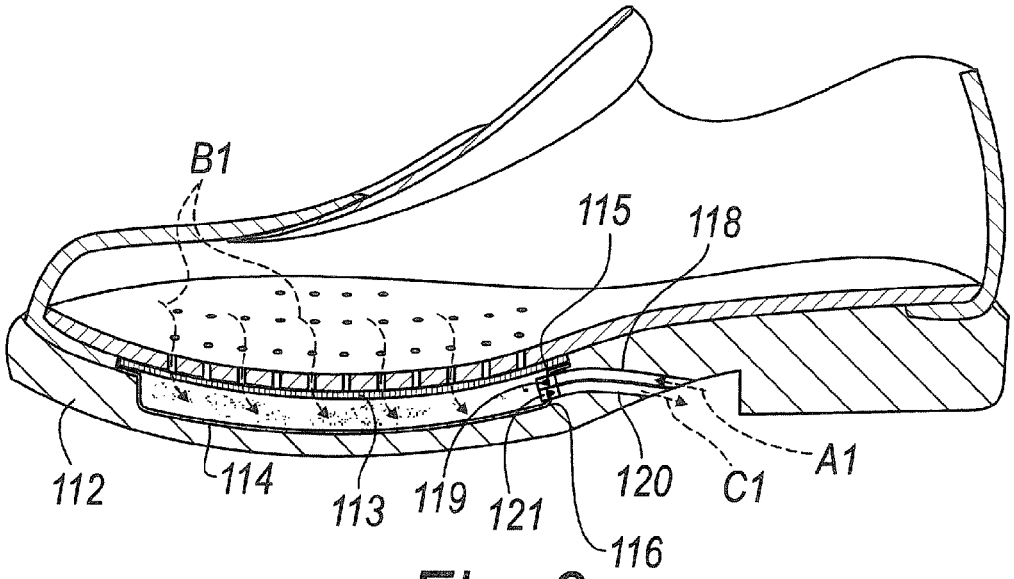
FIG. 3 is a longitudinal sectional view of a second embodiment of the shoe according to the invention.

With reference now to FIG. 3, in a second embodiment a single cavity 114 (pumping chamber) is provided, which is provided directly in the sole 112 by molding and is sealed in an upward region by the membrane 113.

The seal occurs by joining hermetically the membrane 113 to the upper portion of the sole 112.

The cavity 114 again has two openings, of which a first one 115 is adapted to allow the entry of the air (arrow A1) and the second one 116 is adapted to allow the exit of the air mixed with water vapor (arrow C1).

Air suction now occurs with a duct 118 which connects the cavity 114 to an opening which is connected to the outside and is preferably arranged in the sole waist, while a duct 120 connects the cavity 114 to the outside with an opening which is preferably at the sole waist and allows air expulsion.

One-way valves 119 and 121 are arranged respectively in the ducts 118 and 120.

In this case, the membrane 113 constitutes a wall of the cavity 114 which is permeable to water vapor.

The sweat produced by the foot in the form of vapor (arrows B1) passes through the membrane and thus into the cavity 114 to be expelled with the movement of the foot which produces the exchange of the air inside the cavity 114.

In practice it has been found that the invention has achieved the intended aim and objects.

In particular, the action of transfer of the water vapor produced by sweating from the inside of the shoe to the outside has been increased by means of a pumping and exchange of the air contained in a cavity located within the sole.

The invention also allows to change the air inside the shoe.

The invention thus conceived is susceptible of numerous modifications and variations, all of which are within the scope of the appended claims; all the details may further be replaced with other technically equivalent elements.

In practice, the materials used, so long as they are compatible with the specific use, as well as the dimensions, may be any according to requirements and to the state of the art.

The disclosures in Italian Patent Application No. PD2007A000141 from which this application claims priority are incorporated herein by reference.

The invention claimed is:

1. A shoe comprising:

an assembly insole which is vapor-permeable or includes through holes;

an upper which is fixed to the edges of the insole;

a sole below the insole and at the edges of the upper; and at least one cavity provided inside the sole, said at least one cavity including an upper wall which faces said vapor-permeable or perforated assembly insole, the upper wall being constituted by a membrane which covers and seals the cavity, wherein the membrane is waterproof and permeable to water vapor, wherein said at least one cavity includes inlet and outlet ducts for changing the air contained therein, each of the inlet and outlet ducts include one-way valves, and wherein said at least one cavity includes first and second openings, the first opening configured to allow entry of air into said first cavity and the second opening configured to allow the outflow of air toward the outside.

2. The shoe according to claim 1, wherein said at least one cavity is provided separately and is inserted in a corresponding hollow of said sole.

3. The shoe according to claim 1, wherein said at least one cavity is formed directly by a hollow of said sole.

4. The shoe according to claim 1, wherein said waterproof and vapor-permeable upper membrane is made of polymeric material, or polyurethane, expanded polytetrafluoroethylene or polyester, and is in contact with said insole so as to allow passage of humidity from the insole through said membrane.

5. The shoe according to claim 1, wherein material which increases the humidity absorption capacity of said membrane, so-called hydrophilic material, and the consequent vapor permeation, is inserted in said at least one cavity, said material being selected among hydrophilic felt, materials with silicon, and open-cell foams.

6. The shoe according to claim 1, wherein said membrane seals said at least one underlying cavity to ensure air pumping.

7. The shoe according to claim 1, wherein said membrane and said at least one cavity are arranged at the forefoot.

8. The shoe according to claim 1, wherein said inlet duct is connected to the outside of the shoe.

9. The shoe according to claim 1, wherein the inlet duct is connected to the inside of the shoe.

10. The shoe according to claim 1, wherein the outlet duct is connected to the outside of the shoe.

11. The shoe according to claim 1, wherein the outlet duct is connected to at least one other cavity, which includes an outlet duct with a one-way valve connected to the outside of the shoe.

12. The shoe according to claim 11, wherein said at least one other cavity is arranged at the heel.

13. The shoe according to claim 12, wherein said at least one other cavity is provided separately and is inserted in a corresponding hollow of said sole.

14. The shoe according to claim 12, wherein said at least one other cavity is formed directly by a hollow of said sole.

* * * * *